US012385699B2

(12) United States Patent
Wang et al.

(10) Patent No.: US 12,385,699 B2
(45) Date of Patent: Aug. 12, 2025

(54) HEAT SINK

(71) Applicants: YI CHANG CO., LTD., New Taipei (TW); Po-Shen Wang, New Taipei (TW); Hsin-Tzu Kuo, New Taipei (TW)

(72) Inventors: Po-Shen Wang, New Taipei (TW); Hsin-Tzu Kuo, New Taipei (TW)

(73) Assignees: YI CHANG CO., LTD., New Taipei (TW); Po-Shen Wang, New Taipei (TW); Hsin-Tzu Kuo, New Taipei (TW)

( * ) Notice: Subject to any disclaimer, the term of this patent is extended or adjusted under 35 U.S.C. 154(b) by 213 days.

(21) Appl. No.: 18/149,951

(22) Filed: Jan. 4, 2023

(65) Prior Publication Data

US 2023/0228501 A1 Jul. 20, 2023

(30) Foreign Application Priority Data

Jan. 18, 2022 (TW) ..... 111102048

(51) Int. Cl.
*F28F 3/08* (2006.01)
*F28F 9/00* (2006.01)

(52) U.S. Cl.
CPC ..... *F28F 3/086* (2013.01); *F28F 9/001* (2013.01); *F28F 2210/08* (2013.01)

(58) Field of Classification Search
CPC ..... F28D 15/046; F28D 15/0233; Y10T 29/49353; F28F 3/086; F28F 3/12; F28F 9/001; F28F 2210/08; H05K 7/20327
See application file for complete search history.

(56) References Cited

U.S. PATENT DOCUMENTS

2002/0124995 A1* 9/2002 Moon ..... F28D 15/046 165/104.11
2007/0295494 A1* 12/2007 Mayer ..... F28D 15/0233 29/890.032
2010/0254090 A1* 10/2010 Trautman ..... H05K 7/20336 29/890.032

FOREIGN PATENT DOCUMENTS

CN 102538529 A * 7/2012 ..... F28D 15/046
CN 203672207 U * 6/2014 ..... F28D 15/0233
CN 110418543 A 11/2019
CN 111912272 A 11/2020
CN 113566626 A * 10/2021
CN 113804033 A * 12/2021
TW 200800453 A * 1/2008 ..... B23P 15/26

* cited by examiner

*Primary Examiner* — Tho V Duong
(74) *Attorney, Agent, or Firm* — WPAT, PC

(57) ABSTRACT

A heat sink is used to solve the problem of poor capillary effect of a conventional vapor chamber. The heat sink comprises a casing having a chamber filled with a working fluid. The heat sink further comprises at least one metal net disposed in the chamber. The at least one metal net includes a plurality of first metal wires and a plurality of second metal wires. The plurality of first metal wires and the plurality of second metal wires interlace with each other and are woven to form a plurality of holes. Each of the plurality of holes is surrounded and defined by adjacent first metal wires and adjacent second metal wires. The plurality of holes has at least two different sizes.

10 Claims, 12 Drawing Sheets

HEAT SINK

CROSS REFERENCE TO RELATED APPLICATION

The application claims the benefit of Taiwan application serial No. 111102048, filed Jan. 18, 2022, and the entire contents of which are incorporated herein by reference.

BACKGROUND OF THE INVENTION

1. Field of the Invention

The present invention relates to a heat sink and, more particularly, to a heat sink for cooling electronic components.

2. Description of the Related Art

In electronic products, a conventional vapor chamber is coupled to a surface of a heat source. The vapor chamber includes a chamber filled with a working fluid. The working fluid can be heated by the heat source and evaporate. The gaseous working fluid flows to a side remote the heat source and condenses after releasing heat. The condensed working fluid flows back to a side adjacent to the heat source to absorb heat again. Thus, the heat of the heat source can be carried away through continuous circulation, thereby achieving the cooling purpose.

Thus, the efficiency of evaporation and condensation of the working fluid plays an important role in the cooling effect of the vapor chamber. Therefore, a capillary structure is generally disposed in the chamber of the vapor chamber and includes a plurality of tiny holes. As a result, the capillary structure can use the capillary effect to assist in rapid return flow and condensation of the working fluid after evaporation, thereby indirectly enhancing the cooling effect of the vapor chamber. However, the holes of the capillary structure of the conventional vapor chamber have a uniform size, such that the capillary effect provided by the capillary structure is limited and, thus, requires improvement.

SUMMARY OF THE INVENTION

To solve the above problem, an objective of the present invention is to provide a heat sink. The holes of at least one metal net of the heat sink includes a capillary structure having at least two different sizes.

When the terms "front", "rear", "left", "right", "up", "down", "top", "bottom", "inner", "outer", "side", and similar terms are used herein, it should be understood that these terms have reference only to the structure shown in the drawings as it would appear to a person viewing the drawings and are utilized only to facilitate describing the invention, rather than restricting the invention.

As used herein, the term "one", "a" or "an" for describing the number of the elements and members of the present invention is used for convenience, provides the general meaning of the scope of the present invention, and should be interpreted to include one or at least one. Furthermore, unless explicitly indicated otherwise, the concept of a single component also includes the case of plural components.

As used herein, the term "engagement", "coupling", "assembly", or similar terms is used to include separation of connected members without destroying the members after connection or inseparable connection of the members after connection. A person having ordinary skill in the art would be able to select according to desired demands in the material or assembly of the members to be connected.

A heat sink according to the present invention comprises a casing having a chamber filled with a working fluid. The heat sink further comprises at least one metal net disposed in the chamber. The at least one metal net includes a plurality of first metal wires and a plurality of second metal wires. The plurality of first metal wires and the plurality of second metal wires interlace with each other and are woven to form a plurality of holes. Each of the plurality of holes is surrounded and defined by adjacent first metal wires and adjacent second metal wires. The plurality of holes has at least two different sizes.

Thus, in the heat sink according to the present invention, by providing the metal net forming holes of at least two different sizes (such as by punching or rolling the metal net), the overlapped portions can deform, and the overlapped portions may have different extents of deformation under uneven forces, such that the projections of holes surrounded by the plurality of overlapped portions present irregular shapes and form deformed holes having different sizes. Furthermore, by providing the plurality of first metal wires and/or the plurality of second metal wires of the metal net which are arranged by at least two spacings or which abut each other side by side, the plurality of holes defined and surrounded by the plurality of first metal wires and the plurality of second metal wires may have at least two different sizes. Thus, relatively larger holes may serve as the steam passages for the working fluid, whereas relatively smaller holes may provide better capillary action to absorb the working fluid. Therefore, the working fluid may have a better flow rate to increase the cooling efficacy.

In an example, the casing includes a first casing part and a second casing part. The first casing part and/or the second casing part has a receiving compartment which forms the chamber. Therefore, the casing is easy to produce and assemble.

In an example, the plurality of first metal wires and the plurality of second metal wires interlace with each other and are woven to include a plurality of overlapped portions. The plurality of overlapped portions is pressed or rolled to adjust shapes, such that projections of holes surrounded by the plurality of overlapped portions present deformed holes having irregular shapes and having different sizes. Therefore, the holes may have at least two different sizes to respectively provide a steam passage for the working fluid and a better capillary action for absorbing the working fluid.

In an example, the at least one metal net includes overlapped portions which are not punched nor rolled to adjust shapes. Therefore, the holes of the overlapped portions (which are not punched nor rolled to adjust shapes) may have a relatively large size, thereby forming better steam passages for the working fluid.

In an example, at least two adjacent first metal wires and/or at least two adjacent second metal wires form a group, such that the plurality of first metal wires and/or the plurality of second metal wires form plural groups of first metal wires and/or plural groups of second metal wires. Two adjacent first metal wires of each group and/or two adjacent second metal wires of each group have a first spacing therebetween. Two adjacent groups of first metal wires and/or two adjacent groups of second metal wires have a second spacing therebetween. The second spacing is greater than the first spacing. Therefore, the holes surrounded by the plurality of metal wires may have at least two different sizes.

In an example, the plural groups of first metal wires and the plural groups of second metal wires interlace with each other and are woven to include a plurality of overlapped portions, and the plurality of overlapped portions is pressed or rolled to adjust shapes, such that projections of holes surrounded by the plurality of overlapped portions present deformed holes having irregular shapes and having different sizes. Therefore, the holes have at least two different sizes.

In an example, at least two of the plurality of first metal wires and/or at least two of the plurality of second metal wires are woven by helically twisting or intertwining. Therefore, the plurality of metal wires may have tiny gaps therebetween, such that the hole density of the holes of the capillary structure of the plurality of metal wires becomes smaller.

In an example, the at least one metal net includes a plurality of overlapped layers of metal nets. Therefore, after the plurality of metal net layers is overlapped, a capillary structure with deformed holes of various sizes may be formed, and the hole density of the capillary structure of the plurality of metal nets becomes smaller.

In an example, the plurality of first metal wires and/or the plurality of second metal wires of one of the plurality of overlapped layers of metal nets are aligned with the holes of another of the plurality of overlapped layers of metal nets. Therefore, the number of holes per unit area can be increased.

In an example, the plurality of metal nets has different meshes. Therefore, the number of holes per unit area can be increased.

In an example, the plurality of metal nets is overlapped in a vertical direction and is misaligned from each other by an angle in a horizontal direction perpendicular to the vertical direction. Therefore, non-traditional square or rhombic holes may be formed to produce high-density capillary holes of composite shapes.

In an example, the heat sink further comprises at least one supporting member which is sandwiched between a surface of the at least one metal net and an inner wall of the casing. Therefore, collapse or deformation of the surface of the casing resulting from the surface pressure or interior vacuum force (a negative pressure) can be avoided.

In an example, the at least one supporting member includes a plurality of supporting members spaced from each other, and each of the plurality of supporting members is sandwiched between the surface of the at least one metal net and the inner wall of the casing. Therefore, the working fluid can flow through the gap between two adjacent supporting members, such that the gas-liquid phase change can be uniformly proceeded in the chamber, thereby providing a better gas-liquid phase change efficiency in the casing.

DETAILED DESCRIPTION OF THE INVENTION

Figure 1:
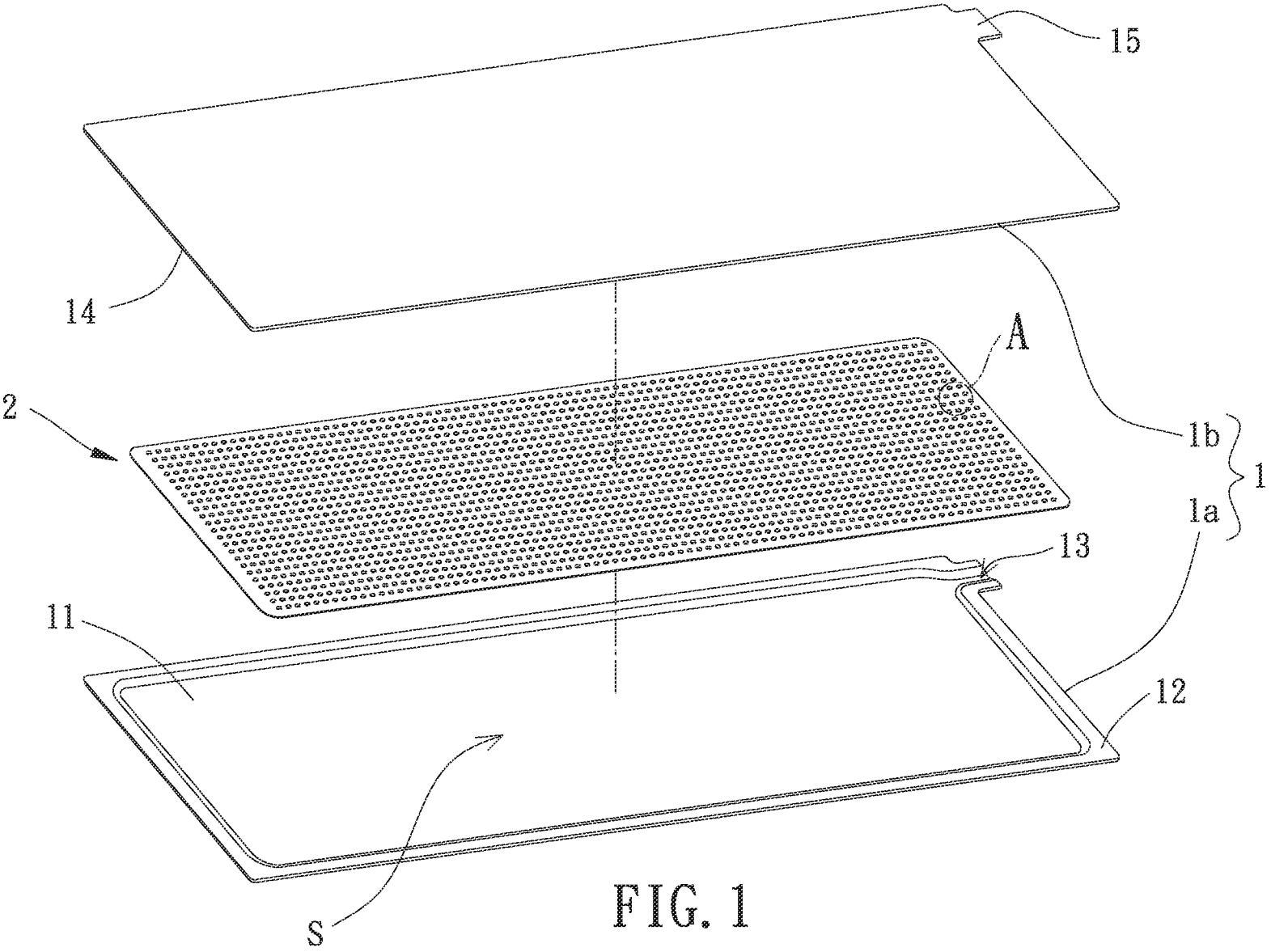
FIG. 1 is an exploded, perspective view of a heat sink of a preferred embodiment according to the present invention.

In order to make the above and other objectives, features, and advantages of the present invention clearer and easier to understand, preferred embodiments of the present invention will be described hereinafter in connection with the accompanying drawings. Furthermore, the elements designated by the same reference numeral in various figures will be deemed as identical, and the description thereof will be omitted.

Please refer to FIG. 1 showing a heat sink of a preferred embodiment according to the present invention. The heat sink comprises a casing 1 and at least one metal net 2. The at least one metal net 2 is disposed in the casing 1.

Figure 13:
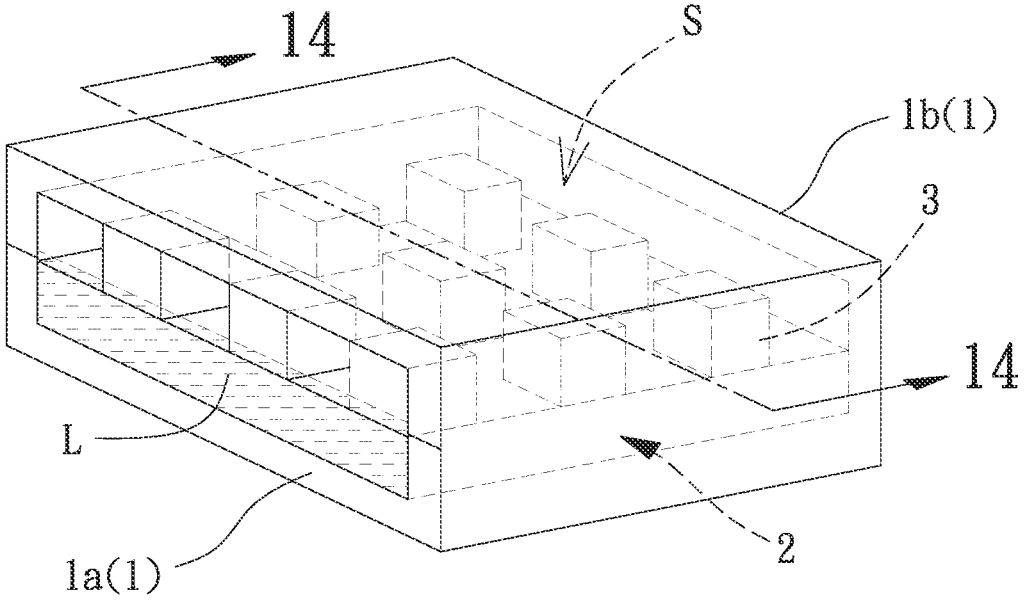
FIG. 13 is a perspective view illustrating a heat sink with at least one supporting member according to the present invention.

With reference to FIGS. 1 and 13, the casing 1 may be made of a material with a thermally conductive property, such as copper, aluminum, titanium, or stainless steel. The casing 1 may be directly or indirectly connected to a heat source, thereby cooling the heat source. The heat source may be a central processor of a mobile phone or any other electronic product, or an electronic element which is disposed on a circuit board and which generates heat during operation, such as a chip. The outline of the casing 1 may be adjusted according to the type or mounting position of the heat sink. The present invention is not limited in this regard. The casing 1 includes a chamber S therein. The chamber S is filled with a working fluid L. The working fluid L may be water, alcohol, or any other fluid. The working fluid L evaporates from a liquid state into a gaseous state by absorbing heat, and the gas-liquid phase change mechanism of the working fluid L can be used to achieve heat transfer. The chamber S is in a sealed vacuum state to avoid loss of the working fluid L in the gaseous state, thereby avoiding adverse influence on the cooling effect.

In this embodiment, the casing 1 may include a first casing part 1*a* and a second casing part 1*b*. The first casing part 1*a* may include a receiving compartment 11 which forms the chamber S. The receiving compartment 11 may be formed by punching, casing, bending or etching. The present invention is not limited in this regard. An annular ledge 12 may be formed around a periphery of the receiving compartment 11. A passage hole 13 extends through the annular ledge 12 and intercommunicates with the receiving compartment 11. The passage hole 13 can be used to suck the air in the chamber S and to fill a working fluid L into the chamber S. The passage hole 13 may be sealed after filling the working fluid L to avoid loss of the working fluid L in the gaseous state.

The second casing part 1*b* may be made of a material the same as or different from the material of the first casing part 1*a*. The second casing part 1*b* may be coupled to the first casing part 1*a* by adhesion or welding. For example, the annular ledge 12 of the first casing part 1*a* is coupled with the second casing part 1*b* by brazing or laser welding. In this embodiment, the second casing part 1*b* may include a coupling portion 14 along a periphery of the second casing part 1*b*. The coupling portion 14 may be coupled with the annular ledge 12 of the first casing part 1*a*, such that the second casing part 1*b* and the first casing part 1*a* jointly form the chamber S. The second casing part 1*b* further includes a sealing portion 15 that may be aligned with the passage hole 13 of the first casing part 1*a*, and solder can be used to seal the passage hole 13.

In another embodiment, the receiving compartment 11 and the passage hole 13 may be formed on the second casing part 1*b* and communicate with each other, the sealing portion 15 is disposed on the first casing part 1*a* and is aligned with the passage hole 13, and solder is used to seal the passage hole 13. Alternatively, each of the first casing part 1*a* and the second casing part 1*b* includes the receiving compartment 11 and the passage hole 13 intercommunicating with the receiving compartment 11. The two passage holes 13 are aligned with each other, and solder is used to seal the two passage holes 13, providing the same function and effect. The present invention is not limited in this regard.

Figure 2:
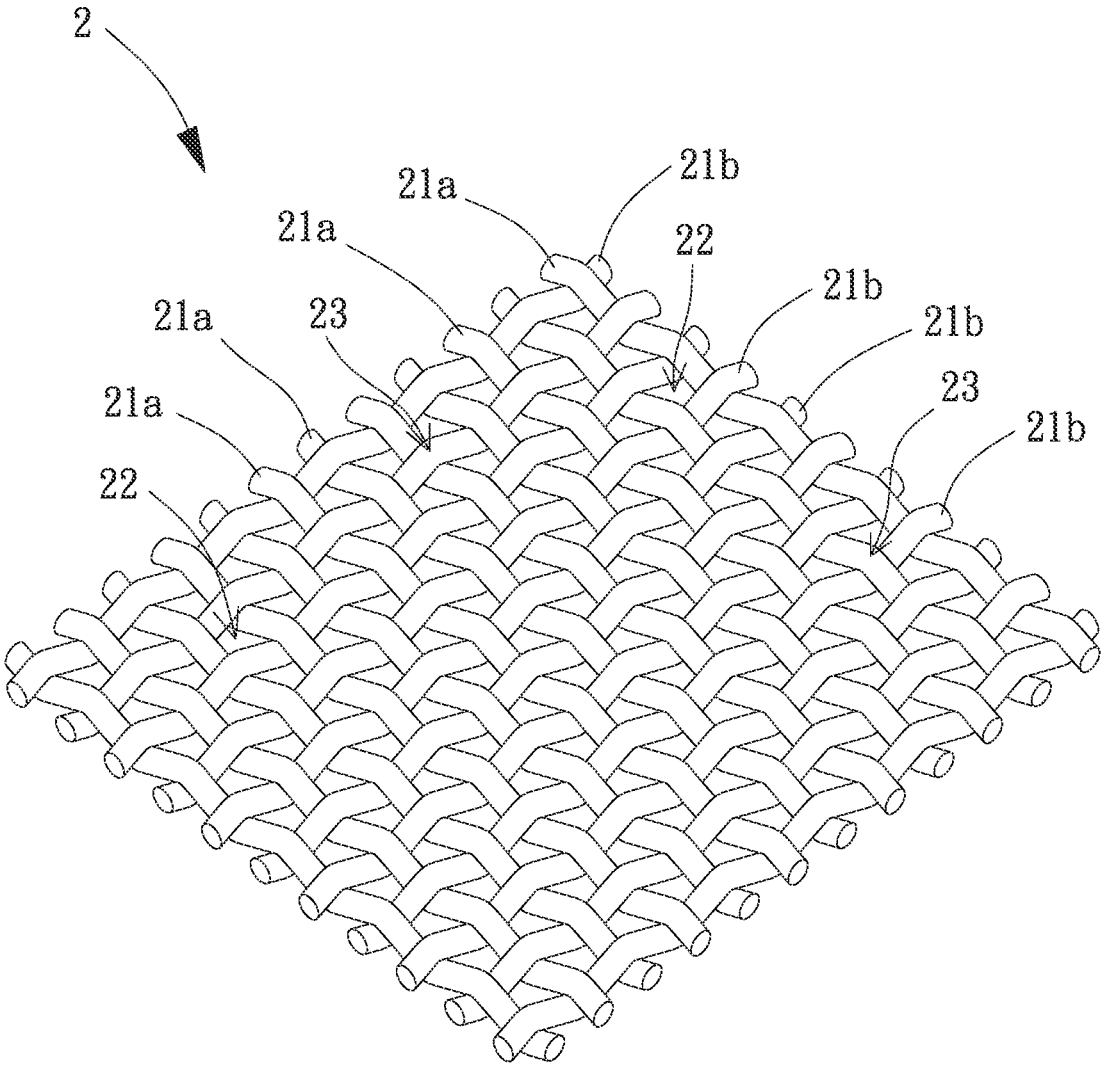
FIG. 2 is a perspective view of a metal net of a first embodiment according to the present invention.

With reference to FIG. 2 illustrating a first embodiment of the metal mesh 2 according to the present invention, the metal mesh 2 may be disposed in the chamber S. The metal mesh 2 may be comprised of a plurality of first metal wires 21*a* and a plurality of second metal wires 21*b*. The plurality of first metal wires 21*a* and the plurality of second metal wires 21*b* may be made of a ductile material, such as copper, aluminum, titanium, or stainless steel. The extending direction of the plurality of first metal wires 21*a* may be perpendicular or not perpendicular to the extending direction of the plurality of second metal wires 21*b*. The plurality of first metal wires 21*a* and the plurality of second metal wires 21*b* interlace with each other and are woven to form a plurality of overlapped portions 23. Two adjacent first metal wires 21*a* and two adjacent second metal wires 21*b* together define a hole 22. Therefore, the plurality of first metal wires 21*a* and the plurality of second metal wires 21*b* interlace with each other to form a net structure having a plurality of holes 22, such that the metal net 2 can be used as a capillary structure of the heat sink, thereby enhancing the evaporation and the capillary efficiency of the working fluid L.

Figure 3:
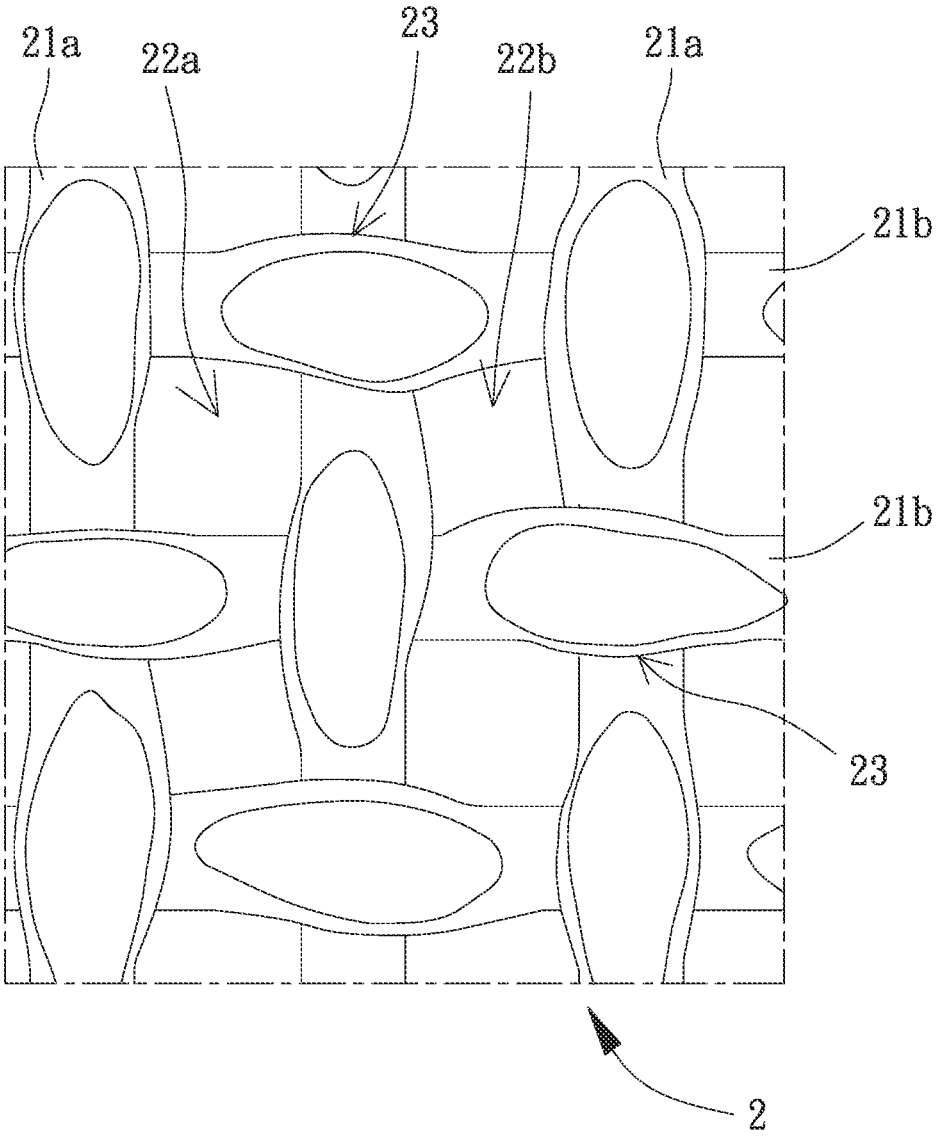
FIG. 3 is an enlarged view of a portion A of FIG. 1.

With reference to FIG. 3, the metal net 2 may be punched or rolled by a mold to deform the overlapped portions 23. Alternatively, according to the extent of punching or rolling, the deformation may flatten the overlapped portions 23 and/extend to each of the plurality of first metal wires 21*a* and/or each of the plurality of second wires 21*b*. Furthermore, the plurality of first metal wires 21*a* and the plurality of second metal wires 21*b* may be subjected to uneven forces and, thus, have different extents of deformation, such that projections of the holes 22 surrounded by the plurality of first metal wires 21*a* and the plurality of second wires 21*b* present deformed holes 22*a*, 22*b* having irregular shapes and having different sizes. Therefore, deformed holes 22*a* of a relatively larger size can provide steam passages for the working fluid L, whereas deformed holes 22*b* of a relatively smaller size can have a better capillary force for absorbing the working fluid L.

Figure 4:
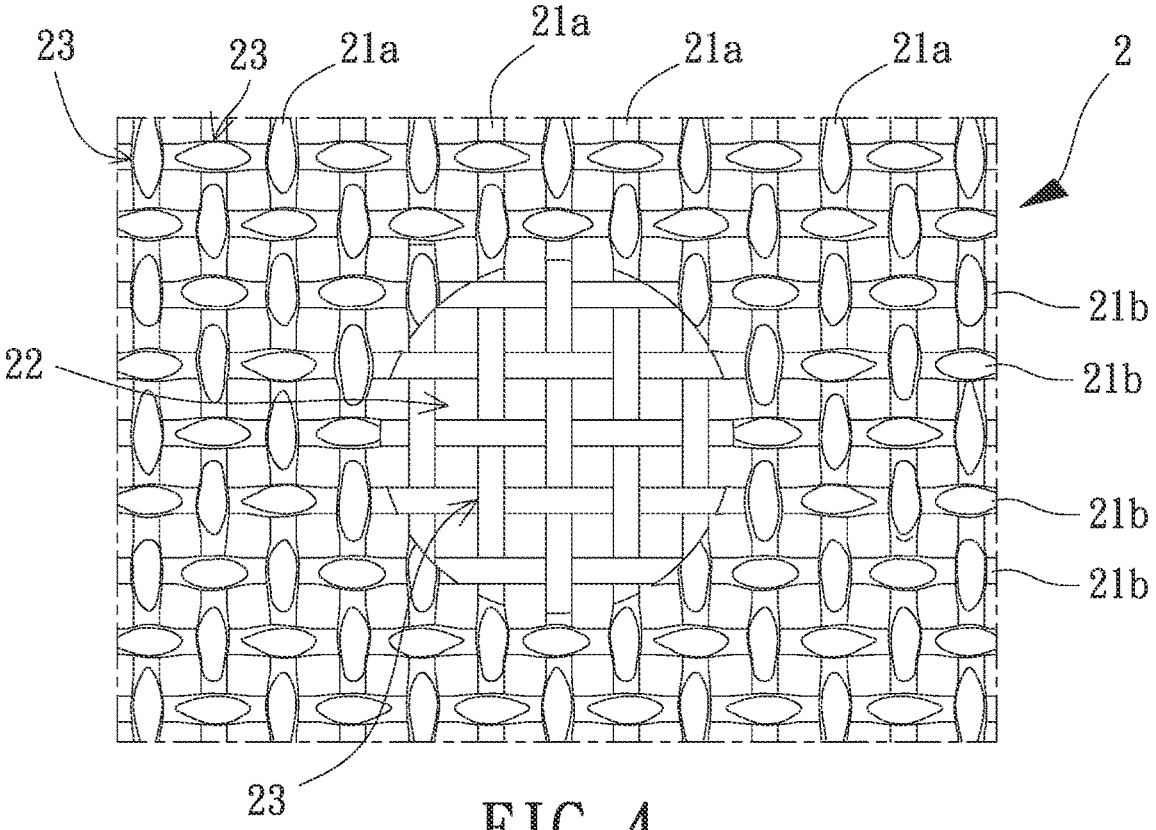
FIG. 4 is a top view of a metal net of a second embodiment according to the present invention.

Please refer to FIG. 4 showing the metal mesh 2 of a second embodiment according to the present invention. This embodiment is substantially the same as the first embodiment. In this embodiment, the mold may include corresponding recessed portions and protruding portions. The recessed portions and the protruding portions of the mold may have predetermined positions and shapes. Therefore, when the mold is used to punch or roll the metal net 2, the overlapped portions 23 corresponding to the recessed portions of the mold are not punched nor rolled. Therefore, the holes 22 defined by the overlapped portions 23 (which are not punched nor rolled) will be larger than the deformed holes 22*a*, 22*b*, thereby forming better steam passages for the working fluid L. Specifically, the overlapped portions 23 (not punched nor rolled) of each of the plurality of first metal wires 21*a* and each of the plurality of second metal wires 21*b* and the holes 22 are not deformed, such that the plurality of first metal wires 21*a* and/or the plurality of second wires 21*b* of the metal net 2 has a shape corresponding to the recessed portions of the mold (such as an approximately circle as shown in the figure).

Figure 5:
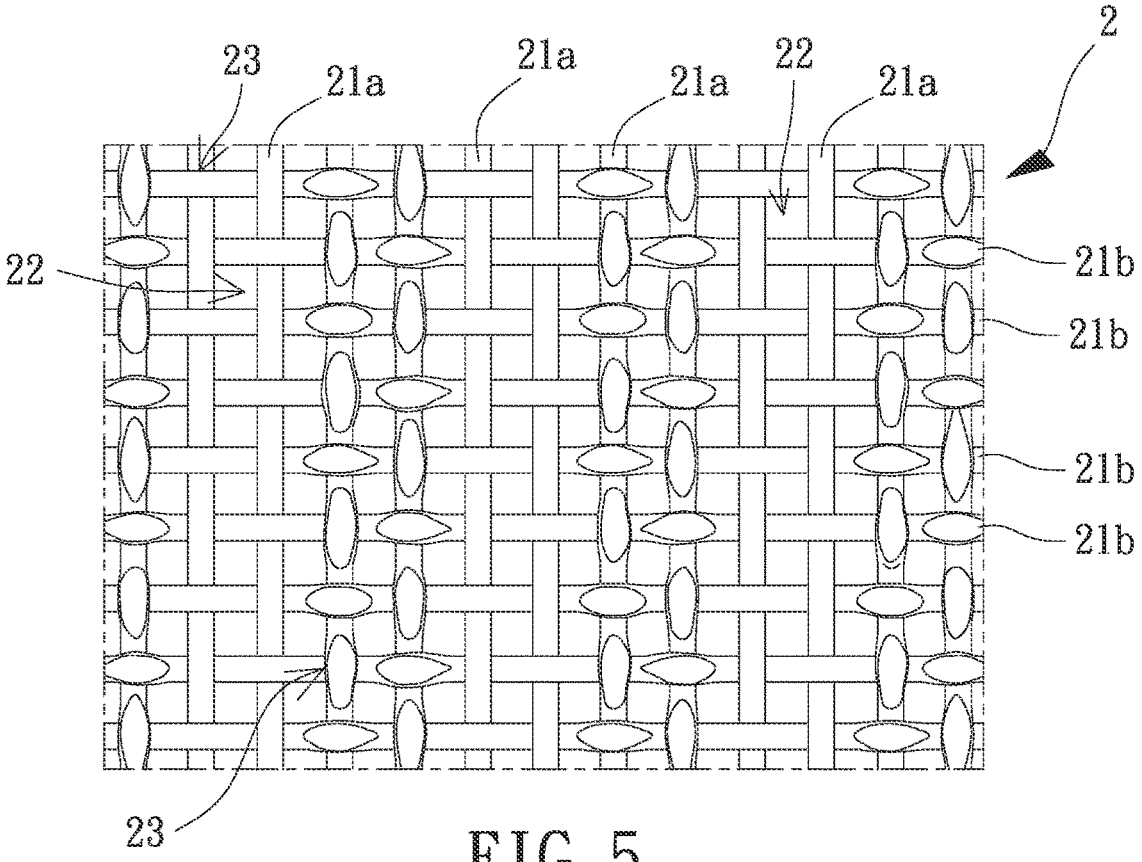
FIG. 5 is a top view of a metal net of a third embodiment according to the present invention.

Please refer to FIG. 5 showing the metal mesh 2 of a third embodiment according to the present invention. This embodiment is substantially the same as the second embodiment. In this embodiment, the overlapped portions 23 (not punched nor rolled) of each of the plurality of first metal wires 21*a* and each of the plurality of second metal wires 21*b* and the holes 22 are not deformed, such that the plurality of first metal wires 21*a* and the plurality of second wires 21*b* of the metal net 2 maintain original elongated shapes.

Figure 6:
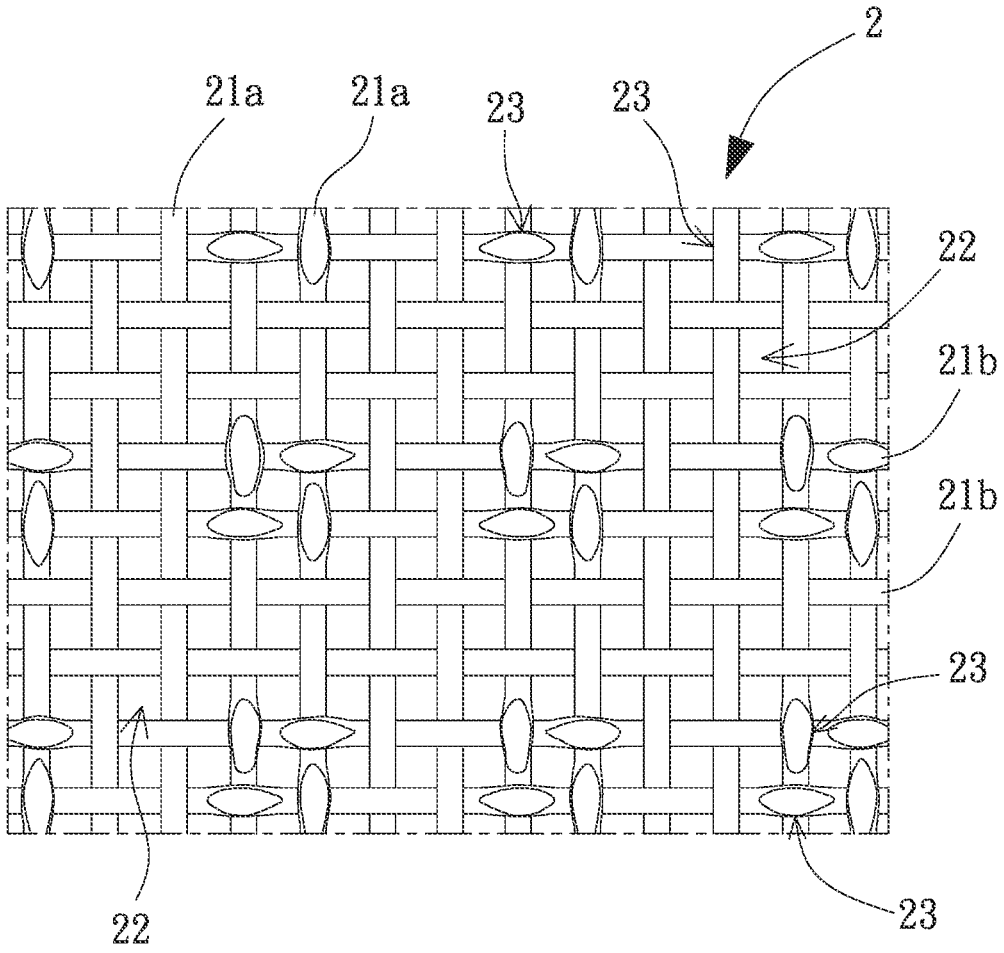
FIG. 6 is a top view of a metal net of a fourth embodiment according to the present invention.

Please refer to FIG. 6 showing the metal mesh 2 of a fourth embodiment according to the present invention. This embodiment is substantially the same as the second embodiment. In this embodiment, the overlapped portions 23 (not punched nor rolled) of each of the plurality of first metal wires 21*a* and each of the plurality of second metal wires 21*b* and the holes 22 are not deformed, such that the plurality of first metal wires 21*a* and the plurality of second wires 21*b* of the metal net 2 maintain interlaced continuous elongated shapes.

Figure 7:
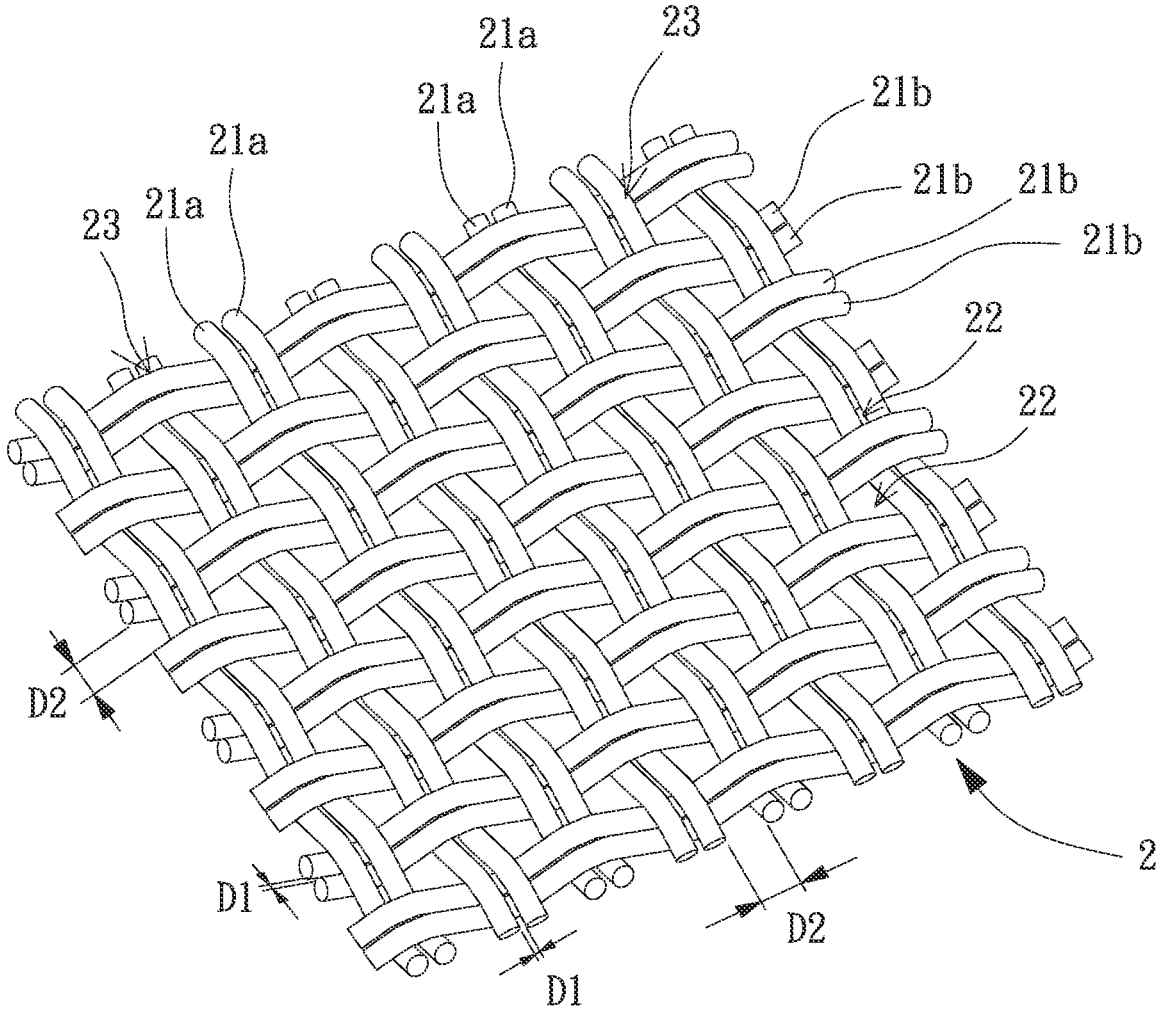
FIG. 7 is a top view of a metal net of a fifth embodiment according to the present invention.

Please refer to FIG. 7 showing the metal mesh 2 of a fifth embodiment according to the present invention. In this embodiment, the plurality of first metal wires 21*a* and/or the plurality of second metal wires 21*b* are arranged by at least two spacings. Specifically, at least two adjacent first metal wires 21*a* form a group, such that the plurality of first metal wires 21*a* form plural groups of first metal wires 21*a*. Two adjacent first metal wires 21*a* of each group have a first spacing D1 therebetween. The first spacings D1 may be the same or different. Two adjacent groups of first metal wires 21*a* have a second spacing D2 therebetween. The second spacings D2 may be the same or different. Alternatively or additionally, the plurality of second metal wires 21*b* may be arranged by at least two spacings. Namely, at least two adjacent second metal wires 21*b* form a group, such that the plurality of second metal wires 21*b* form plural groups of second metal wires 21*b*. Two adjacent metal second wires 21*b* of each group have a first spacing D1 therebetween. The first spacings D1 may be the same or different. Two adjacent groups of second metal wires 21*b* have a second spacing D2 therebetween. The second spacings D2 may be the same or different. Therefore, the plurality of first metal wires 21*a* and the plurality of second metal wires 21*b* may form a plurality of holes 22 having different sizes.

In another embodiment, at least two adjacent first metal wire 21*a* and/or at least two adjacent second metal wire 21*b* may abut each other side by side. When two first metal wires 21*a* and/or two adjacent second metal wires 21*b* abut each other, a spacing may be formed between the circular peripheries. A gap formed by the spacing may also provide a capillary action for the working fluid L. Based on this principle, in other embodiments, at least two first metal wires 21*a* and/or at least two second metal wires 21*b* are woven by helically twisting or intertwining. The present invention is not limited in this regard.

Figure 8:
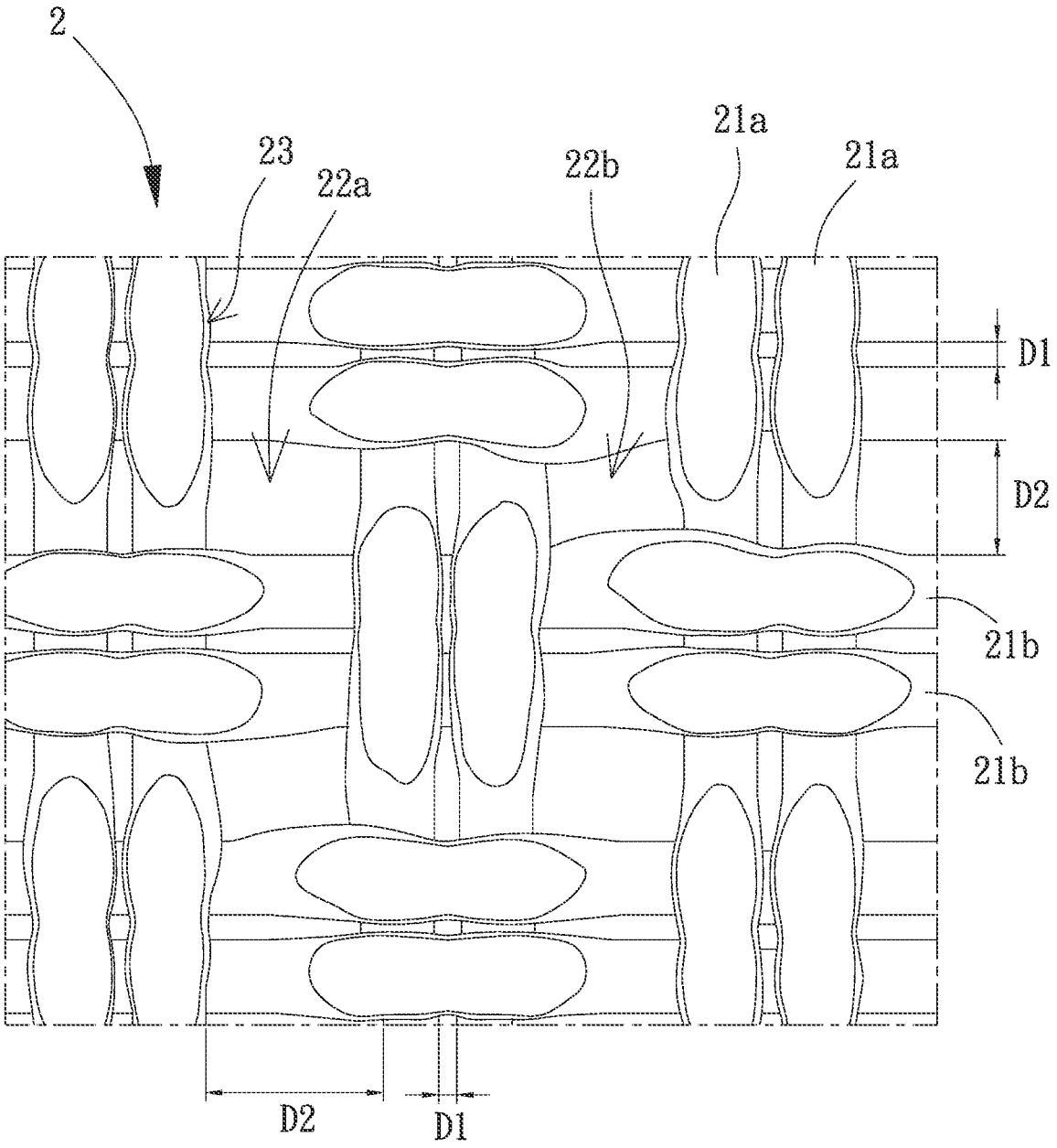
FIG. 8 is a top view of a metal net of a sixth embodiment according to the present invention.

Please refer to FIG. 8 showing the metal mesh 2 of a sixth embodiment according to the present invention. In this embodiment, the metal net 2 of the fifth embodiment is punched or rolled by a mold to deform the plurality of first metal wires 21*a* and the plurality of second metal wires 21*b* (such as the overlapped portions 23). Therefore, the plurality of first metal wires 21*a* and the plurality of second metal wires 21*b* may have different extents of deformation under uneven forces, such that the projections of the holes 22 surrounded by the plurality of first metal wires 21*a* and the plurality of second metal wires 21*b* present deformed holes 22*a*, 22*b* having irregular shapes and having different sizes. This further permits different changes of the diameters of the holes 22 to provide the working fluid L with better evaporation and capillary efficiency.

Figure 9:
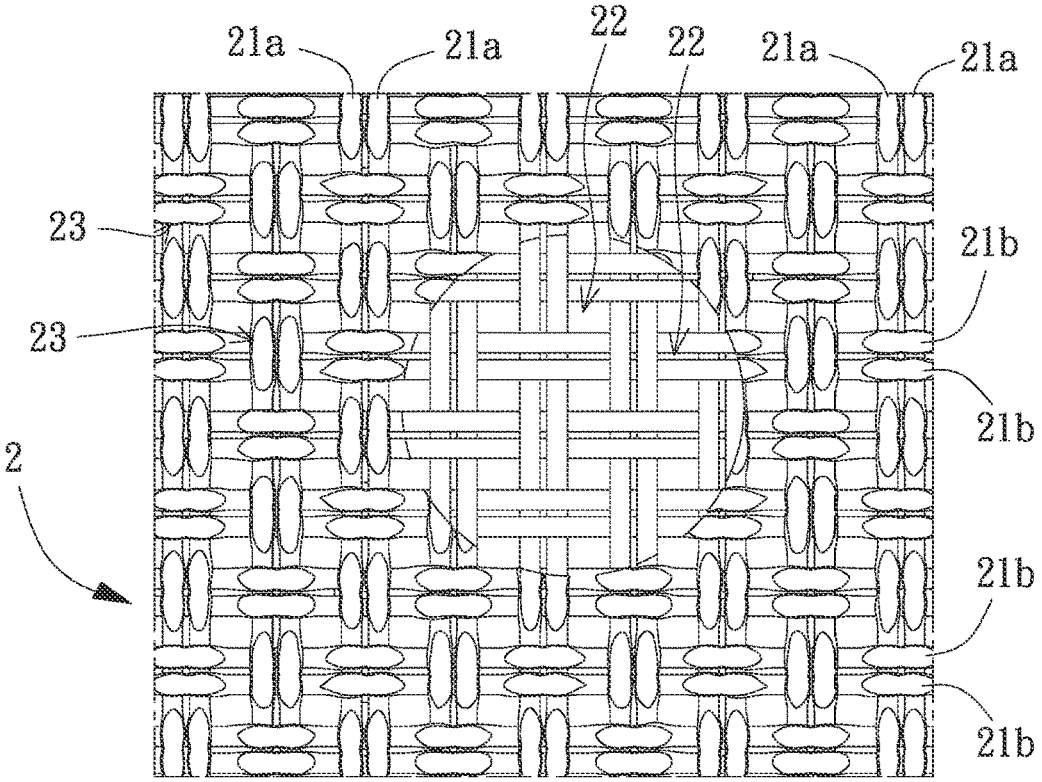
FIG. 9 is a top view of a metal net of a seventh embodiment according to the present invention.

Please refer to FIG. 9 showing the metal mesh 2 of a seventh embodiment according to the present invention. In this embodiment, the metal net 2 may also be punched or rolled by a mold. The mold may include corresponding recessed portions and protruding portions, and the overlapped portions 23 aligned with the recessed portions of the mold are not punched nor rolled. Therefore, the overlapped portions 23 (not punched nor rolled) of each first metal wire 21*a* and each second metal wire 21*b* and the holes 22 are not deformed, such that the metal net 2 has a shape corresponding to the recessed portions (such as an approximately circle shown in the figure).

Figure 10:
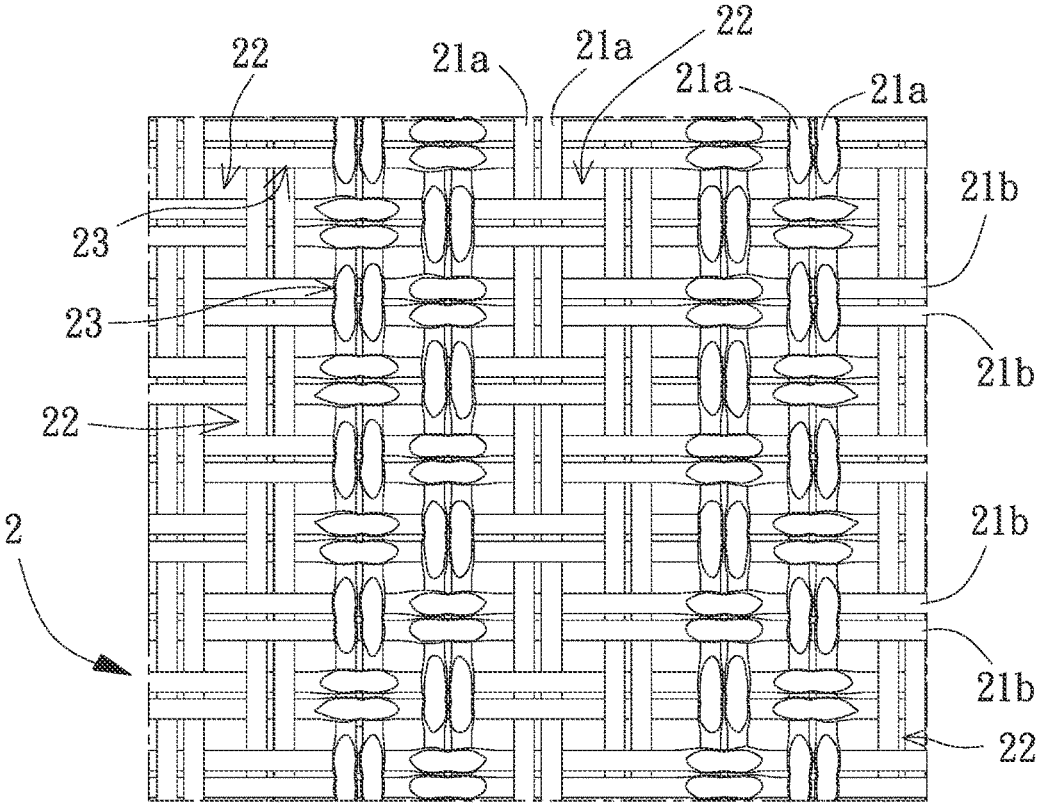
FIG. 10 is a top view of a metal net of an eighth embodiment according to the present invention.

Please refer to FIG. 10 showing the metal mesh 2 of an eighth embodiment according to the present invention. In this embodiment, the metal net 2 may also be punched or rolled by a mold. The mold may include corresponding recessed portions and protruding portions, and the overlapped portions 23 aligned with the recessed portions of the mold. Therefore, the overlapped portions 23 (not punched nor rolled) of each first metal wire 21*a* and each second metal wire 21*b* and the holes 22 are not deformed, such that the plurality of first metal wires 21*a* and the plurality of second metal wires 21*b* maintain original elongated shapes.

Figure 11:
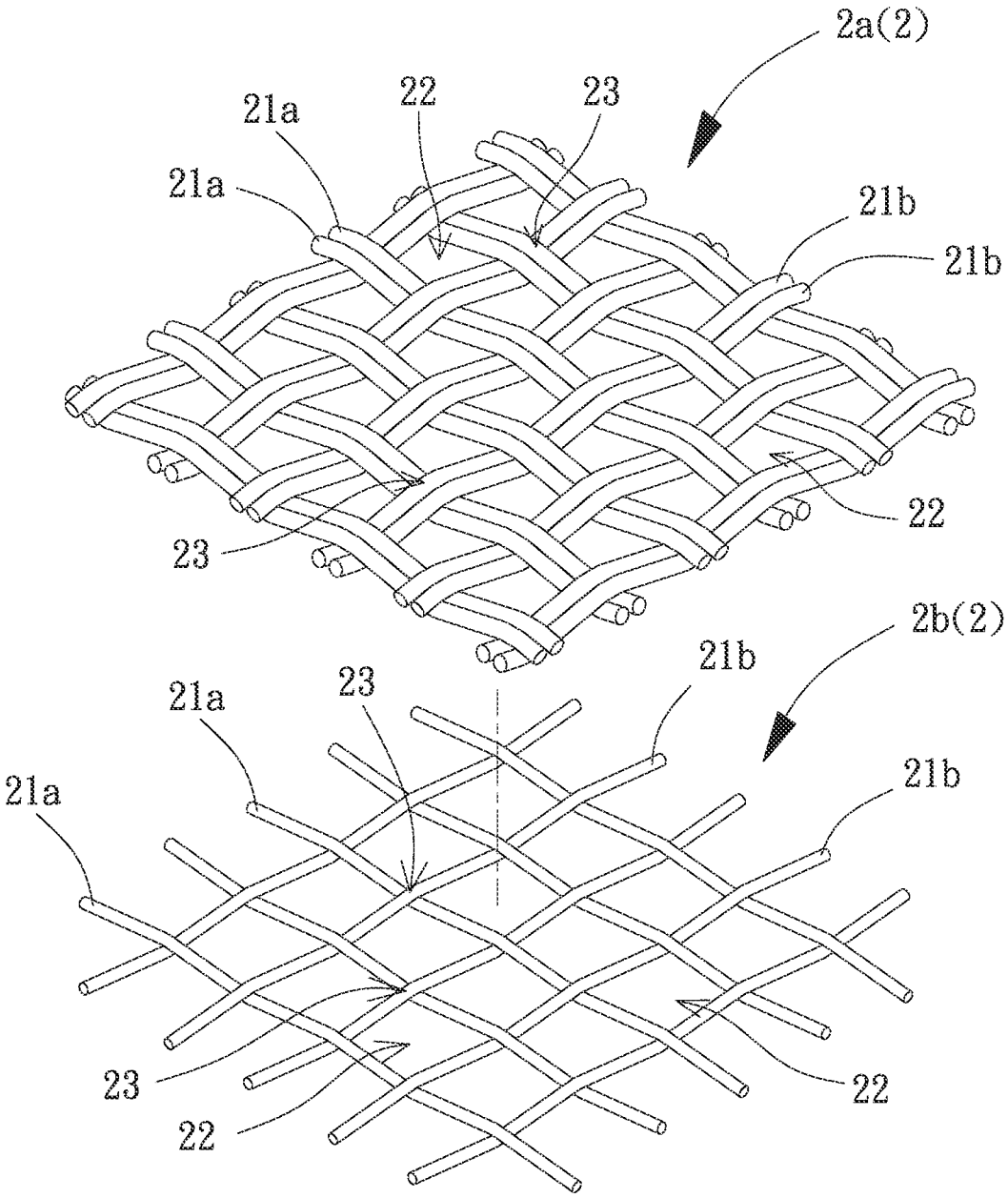
FIG. 11 is an exploded, perspective view illustrating overlapping of plural metal net layers according to the present invention.
Figure 12:
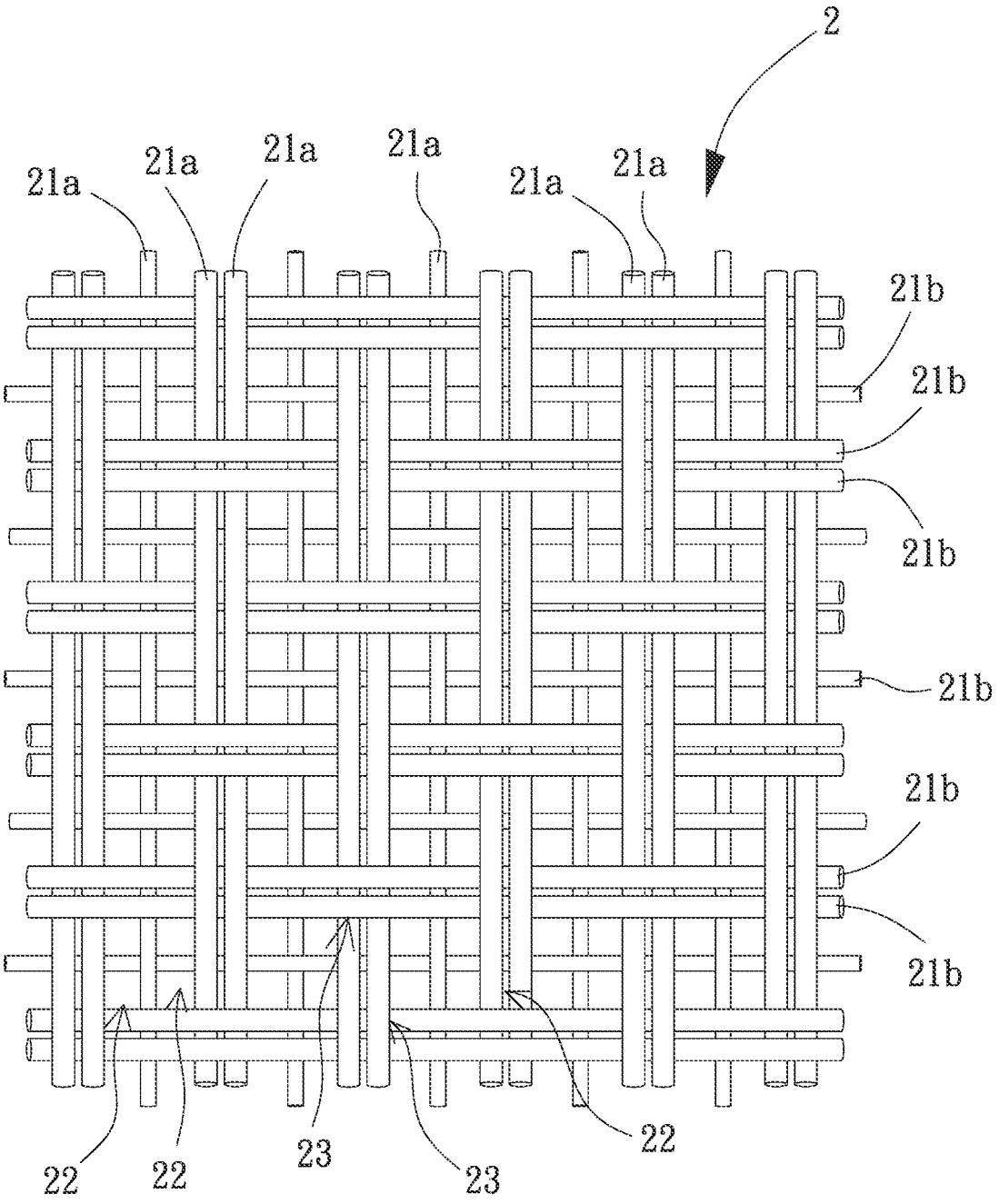
FIG. 12 is a top view of plural overlapped metal net layers according to the present invention.
Figure 15:
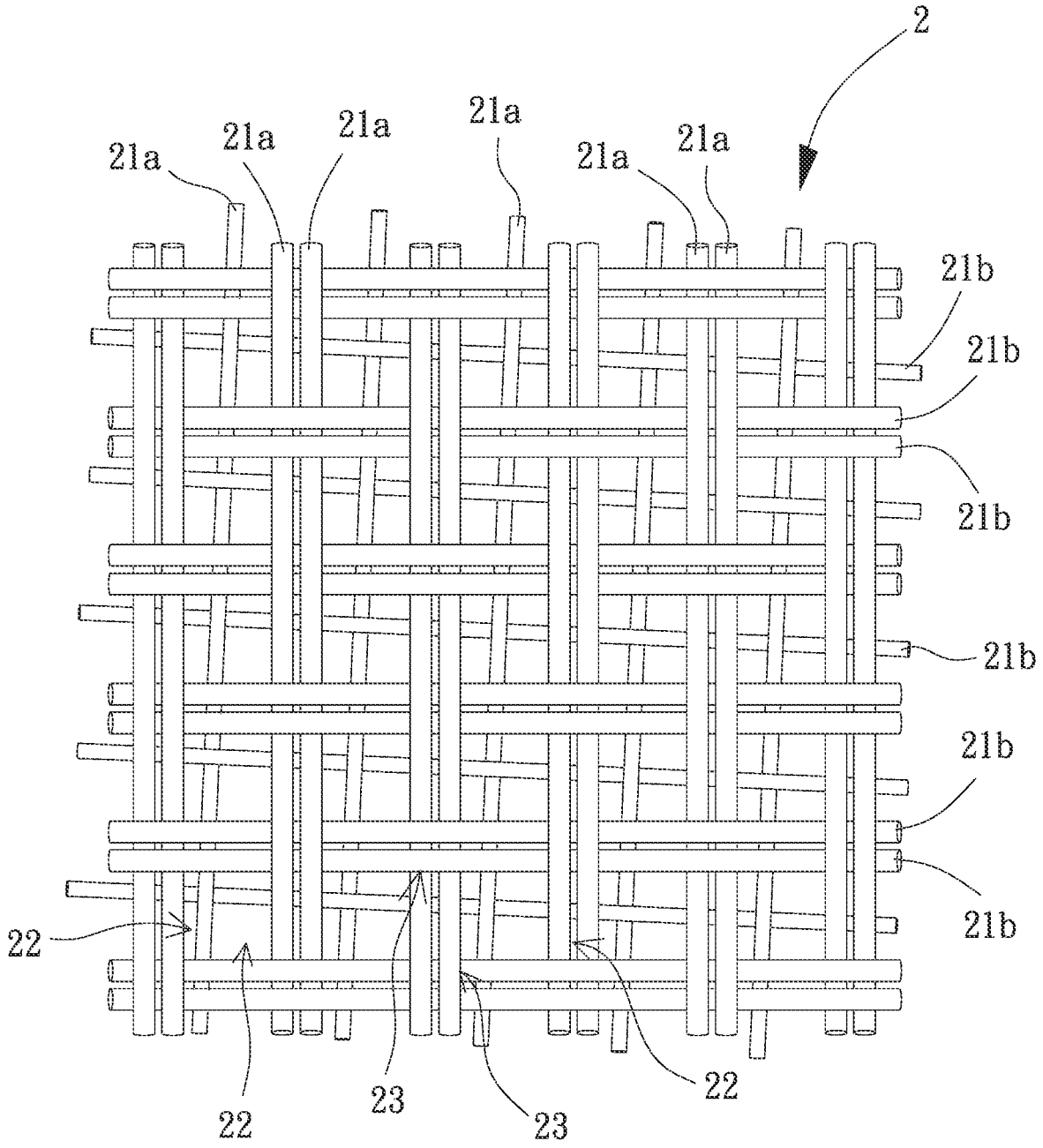
FIG. 15 is a top view similar to FIG. 12 with one of the overlapped metal net layers rotated by an angle related to the other one of the overlapped metal net layers.

With reference to FIGS. 11 and 12, the heat sink may include a plurality of overlapped metal nets 2. In this embodiment, an illustrative example having two metal nets 2*a* and 2*b* is set forth. When the two metal nets 2*a* and 2*b* are overlapped, the first metal wires 21*a* and/or the second metal wires 21*b* of the upper (or lower) metal net 2*b* are aligned with the holes 22 of the lower (or upper) metal net 2*a*. Furthermore, the two metal nets 2*a* and 2*b* may have the same mesh or different meshes. The present invention is not limited in this regard. In another embodiment, the two metal nets 2*a*, 2*b* are overlapped in a vertical direction and are misaligned from each other by an angle in a horizontal direction perpendicular to the vertical direction (as shown in FIG. 15). Therefore, the plurality of metal nets 2 after overlapping may form a capillary structure with deformed holes 22*a*, 22*b* of various sizes, and the hole density of the capillary structure of the plurality of metal nets 2 becomes smaller.

It is worth mentioning that the metal net 2 (whose overlapped portions 23 are punched or rolled) or the plurality of first metal wires 21*a* and/or the plurality of second metal wires 21*b* (which are arranged by at least two spacings) disclosed in each of the above embodiments is applicable to the example of the plurality of overlapped metal layers 2. Therefore, the present invention is not limited to the examples disclosed by the figure of each embodiment.

Figure 14:
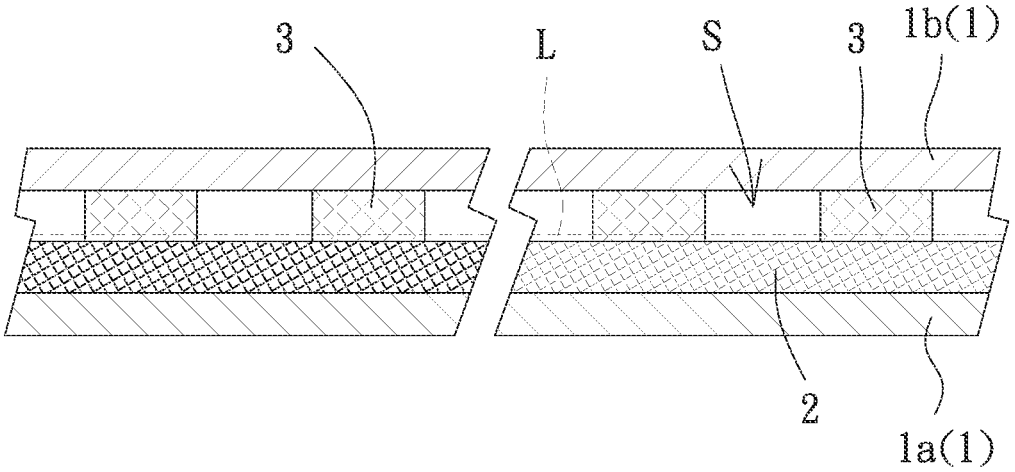
FIG. 14 is a cross sectional view taken along section line 14-14 of FIG. 13.

With reference to FIGS. 13 and 14, in another embodiment of the heat sink according to the present invention, the heat sink further include at least one supporting member 3 aside from a casing 1 and at least one metal net 2. The at least one supporting member 3 is sandwiched between a surface of the at least one metal net 2 and an inner wall of the casing 1 disclosed in each of the above embodiments. Namely, the at least one supporting member 3 is sandwiched between a surface of the at least one metal net 2 and at least one of the first casing part 1*a* and the second casing part 1*b* disclosed in each of the above embodiments. The at least one supporting member 3 may be welded to a surface of the metal net 2. Alternatively, the at least one supporting member 3 may be formed by sintering metal powders onto a surface of the metal net 2. The present invention is not limited in this regard. Therefore, the at least one supporting member 3 can avoid collapse or deformation of the surface of the first casing part 1*a* and/or the second casing part 1*b* resulting from the surface pressure or interior vacuum force (a negative pressure). Furthermore, the at least one supporting member 3 may be plural. The plural supporting members 3 may be spaced from each other, and each supporting member 3 may be sandwiched between a surface of the metal net 2 and the inner wall of the casing 1. Therefore, the working fluid L can flow through the gap between each two adjacent supporting members 3 to reduce the hindrance to the working fluid L by the at least one supporting member 3, such that the gas-liquid phase change can be uniformly proceeded in the chamber S to thereby enhance the efficiency of the gas-liquid phase change in the casing 1.

In view of the foregoing, in the heat sink according to the present invention, by providing the metal net 2, 2*a*, 2*b* forming holes 22 of at least two different sizes (such as by punching or rolling the metal net 2, 2*a*, 2*b*), the overlapped portions 23 can deform, and the overlapped portions 23 may have different extents of deformation under uneven forces, such that the projections of holes 22 surrounded by the plurality of overlapped portions 23 present irregular shapes and form deformed holes 22*a*, 22*b* having different sizes. Furthermore, by providing the plurality of first metal wires 21*a* and/or the plurality of second metal wires 21*b* of the metal net 2 which are arranged by at least two spacings or which abut each other side by side, the plurality of holes 22 defined and surrounded by the plurality of first metal wires 21*a* and the plurality of second metal wires 21*b* may have at least two different sizes. Thus, relatively larger holes may serve as the steam passages for the working fluid L, whereas relatively smaller holes may provide better capillary action to absorb the working fluid L. Therefore, the working fluid L may have a better flow rate to increase the cooling efficacy.

Although the present invention has been described with respect to the above preferred embodiments, these embodiments are not intended to restrict the present invention. Various changes and modifications on the above embodiments made by any person skilled in the art without departing from the spirit and scope of the present invention are still within the technical category protected by the present invention. Accordingly, the scope of the present invention shall include the literal meaning set forth in the appended claims and all changes which come within the range of equivalency of the claims. Furthermore, in a case that several of the above embodiments can be combined, the present invention includes the implementation of any combination.

What is claimed is:

1. A heat sink comprising:

a casing including a chamber filled with a working fluid; and at least one metal net disposed in the chamber, wherein the at least one metal net includes a plurality of first metal wires and a plurality of second metal wires, wherein the plurality of first metal wires and the plurality of second metal wires interlace with each other and are woven to form a plurality of holes, wherein each of the plurality of holes is surrounded and defined by two adjacent first metal wires and two adjacent second metal wires, and wherein the plurality of holes have at least two different sizes;

wherein at least two adjacent first metal wires and/or at least two adjacent second metal wires form a group, such that the plurality of first metal wires and/or the plurality of second metal wires form plural groups of first metal wires and/or plural groups of second metal wires, wherein two adjacent first metal wires of each group and/or two adjacent second metal wires of each group have a first spacing therebetween, wherein two adjacent groups of first metal wires and/or two adjacent groups of second metal wires have a second spacing therebetween, and wherein the second spacing is greater than the first spacing; and wherein the plural groups of first metal wires and the plural groups of second metal wires interlace with each other and are woven to include a plurality of overlapped portions, and wherein the plurality of overlapped portions is pressed or rolled to adjust shapes, such that projections of holes surrounded by the plurality of overlapped portions present deformed holes having irregular shapes and having different sizes.

2. The heat sink as claimed in claim 1, wherein the casing includes a first casing part and a second casing part, wherein the first casing part and/or the second casing part has a receiving compartment which forms the chamber.

3. The heat sink as claimed in claim 1, wherein the at least one metal net includes overlapped portions which are not punched nor rolled to adjust shapes.

4. The heat sink as claimed in claim 1, wherein at least two of the plurality of first metal wires and/or at least two of the plurality of second metal wires are woven by helically twisting or intertwining.

5. The heat sink as claimed in claim 1, wherein the at least one metal net includes a plurality of overlapped layers of metal nets.

6. The heat sink as claimed in claim 5, wherein the plurality of first metal wires and/or the plurality of second metal wires of one of the plurality of overlapped layers of metal nets are aligned with the holes of another of the plurality of overlapped layers of metal nets.

7. The heat sink as claimed in claim 5, wherein the plurality of metal nets has different meshes.

8. The heat sink as claimed in claim 5, wherein the plurality of metal nets is overlapped in a vertical direction and is misaligned from each other by an angle in a horizontal direction perpendicular to the vertical direction.

9. The heat sink as claimed in claim 1, further comprising at least one supporting member, wherein the at least one supporting member is sandwiched between a surface of the at least one metal net and an inner wall of the casing.

10. The heat sink as claimed in claim 9, wherein the at least one supporting member includes a plurality of supporting members spaced from each other, and wherein each of the plurality of supporting members is sandwiched between the surface of the at least one metal net and the inner wall of the casing.

* * * * *